United States Patent [19]

Boyer et al.

[11] 3,949,936

[45] Apr. 13, 1976

[54] CONTROL SYSTEM FOR BOILERS FURNISHING STEAM FOR HEATING

[76] Inventors: Charles Boyer, 3900 Bailey Ave.; Michael Pemenidis, 3850 Hudson Manor Terrace, both of Bronx, N.Y. 10463

[22] Filed: Mar. 4, 1974

[21] Appl. No.: 447,666

[52] U.S. Cl. ..... 236/26 A; 236/46 R; 237/9 R

[51] Int. Cl.[2] ..... F24D 1/00; F23N 5/20

[58] Field of Search ..... 236/26 A, 26 R, 46; 337/302, 303, 301; 237/9 R, 67

[56] References Cited

UNITED STATES PATENTS

| | | | |
|---|---|---|---|
| 2,162,116 | 6/1939 | Peltz | 236/46 |
| 2,175,945 | 10/1939 | Simpson | 236/46 X |
| 2,263,422 | 11/1941 | Harris | 237/9 X |
| 2,304,802 | 12/1942 | Crew | 236/46 X |

*Primary Examiner*—William E. Wayner

*Attorney, Agent, or Firm*—Watson Leavenworth Kelton & Taggart

[57] ABSTRACT

Time controlled switching apparatus is connected in series circuit with a steam pressure sensor and a line starter associated with a boiler firing system. The switching apparatus is rendered electrically conductive during spaced time intervals of successive hours whereby boiler firing occurs during preselected time periods and then only where generated steam is at preselected pressure level.

7 Claims, 1 Drawing Figure

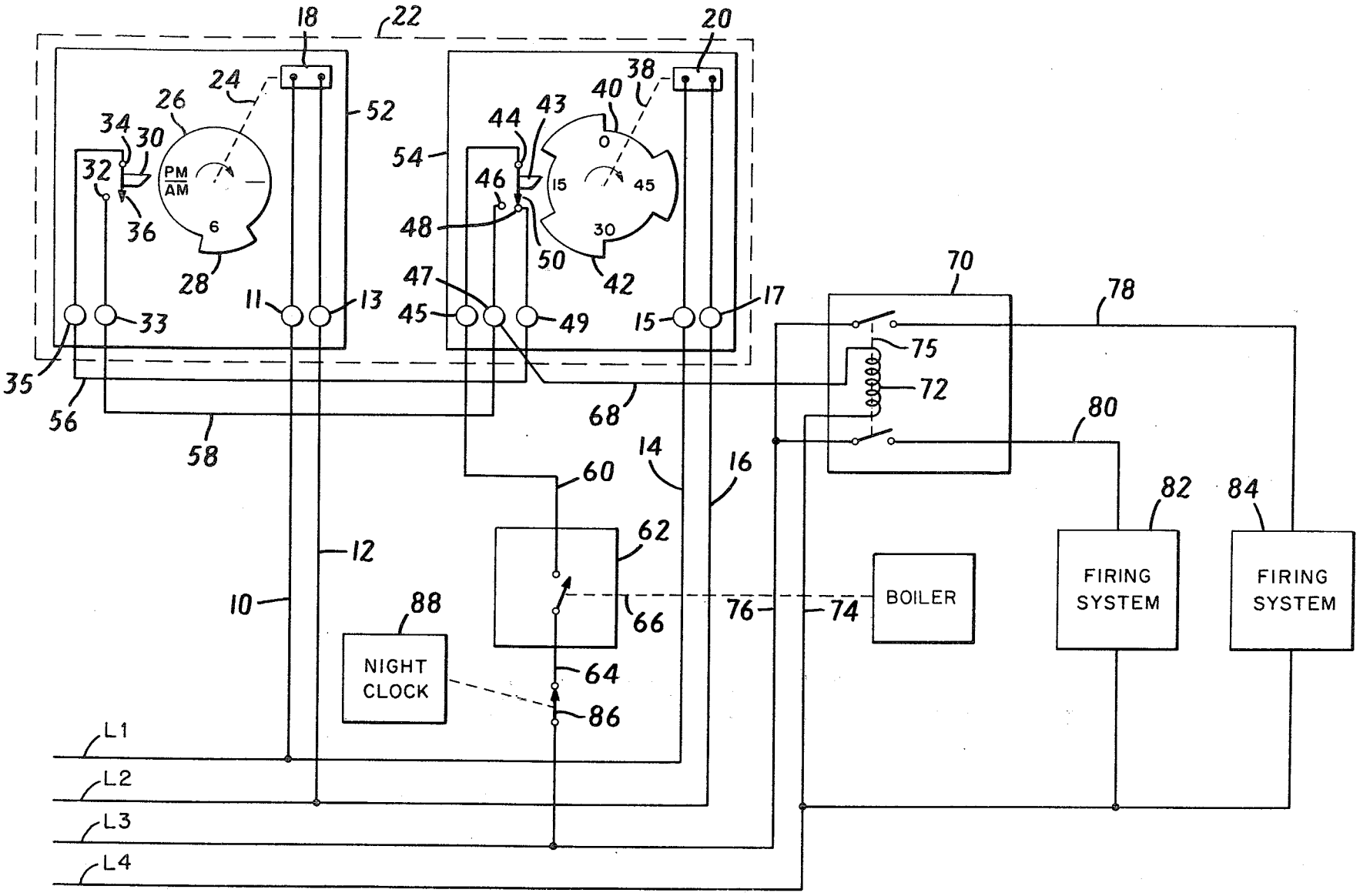
FIRING SYSTEM
FIRING SYSTEM
BOILER
NIGHT CLOCK
PM
AM
L1
L2
L3
L4

CONTROL SYSTEM FOR BOILERS FURNISHING STEAM FOR HEATING

FIELD OF THE INVENTION

This invention pertains generally to steam generators and more particularly to control systems for fuel-fired boilers of the type commonly used in supplying steam for use in the heating of dwellings.

BACKGROUND OF THE INVENTION

Existing control systems for oil-fired boilers furnishing steam to multiple apartment dwellings are operative to fire the boilers, and hence consume fuel oil, in accordance with boiler steam pressure. In practice, suitably spaced high and low steam pressure limits are established and sensed by pressure-sensitive electrical switch means. The boilers are fired where steam pressure falls below the low pressure limit and firing is discontinued when steam pressure rises to the high pressure limit. These existing control systems direct such boiler firing by connecting, in series circuit with such switch means, a magnetic line starter or the like which supplies electrical power to the oil-firing systems of each of the participating boilers. When the switch means provides electrical continuity therethrough, each oil-firing system is then operated if the sensing devices thereof, i.e., flame detector, low water detector, and the like, indicate that conditions particular to the boiler associated therewith are proper.

This so-called "pressure demand" control system, or equivalent system monitoring high and low limits of steam characteristics indicative of the stored heat content thereof, has no more than a coarse capacity for monitoring dwelling heat losses, i.e., to the extent that a decrease in the measured steam characteristic correlates generally with some heat loss. Actual dwelling temperature comfort control is effected, however, by valve means responsive to an auxiliary control system for regulating the flow of generated steam from the boilers to the dwelling.

While the functional independence of the pressure demand control system and such auxiliary temperature-based control system is necessary, the arrangement does not adapt itself particularly well to energy conservation. Thus, occasions arise where the former system calls for firing boilers while the latter system concurrently calls for a reduction in the supply of steam to the dwelling.

SUMMARY OF THE INVENTION

The present invention provides means for conserving fuel in such stored heat monitoring demand-type control systems for steam generators.

The invention introduces, in such existing demand control systems, time-based override means effective to foreshorten fuel consumption periods therein and to conform the same to a preselected schedule without adversely affecting comfort levels. In brief summary thereof, the invention arranges time-controlled switch means in series circuit with the aforementioned stored heat monitoring means and line starter. The time-controlled switch means desirably provides electrical continuity therethrough during spaced time intervals of successive hourly periods.

The foregoing and other features of the invention will be further understood from the following detailed description of a preferred embodiment thereof and from the drawing.

DESCRIPTION OF THE DRAWING

The drawing shows a schematic diagram of a control system in accordance with the invention and connections thereof to oil-firing systems of plural participating boilers.

DESCRIPTION OF THE PREFERRED EMBODIMENT

Referring to the drawing, lines L1 and L2 are fused power mains including a suitable circuit breaker and continuously furnish electrical power respectively through line pairs 10-12, and access terminals 11-13, and line pairs 14-16, and access terminals 15-17, to motors 18 and 20 of clock-controlled switch means 22. The output shaft of motor 18 is connected by mechanical linkage 24 to time cam support member 26. Member 26 rotates in the direction indicated by the arrow and defines at its periphery an adjustable time cam 28 engageable with actuator 30 of a first clock-controlled switch comprising a first terminal 32, a second terminal 34 and a contact arm 36. Contact arm 36 is illustrated in what will be called its normal position wherein electrical continuity is not provided between terminals 32 and 34 or their respective access terminals 33 and 35. During the period in which time cam 28 engages actuator 30, contact arm 36 is moved from its normal position into a further position, wherein electrical continuity is provided between terminals 32 and 34.

Linkage 24 incorporates a gear mechanism providing for cyclic rotation of time cam support member 26 on a 24 hour schedule. In the embodiment particularly shown in the drawing, time cam 28 extends from shortly before 6 o'clock A.M. to approximately 9 o'clock A.M. and contact arm 36 is thereby disposed in such further position during this time period respectively on successive days.

Motor 20 is connected by mechanical linkage 38 to time cam support member 40 which defines spaced timed cams 42 about its periphery engageable with actuator 43 of a second clock-controlled switch comprising first terminal 44, second terminal 46, third terminal 48 and contact arm 50. Access terminals 45, 47 and 49 are provided respectively for terminals 44, 46 and 48. In its illustrated normal position contact arm 50 provides electrical continuity between terminal 44 and terminal 48. Upon engagement of each time cam 42 with actuator 43, contact arm 50 is moved to a further position wherein electrical continuity is provided between terminals 44 and 46.

Linkage 38 incorporates a gear mechanism providing for cyclic rotation of time cam support member 40 on an hourly schedule. In the embodiment particularly shown, three time cams are spaced about the periphery of member 40, each defining an approximate ten minute period.

Individual units 52 and 54 of clock-controlled switch means 22 are preferably comprised of commercially available apparatus. Unit 52 thus may be a 24 HR Tork No. 8001 Time Clock and unit 54 may be a 1 HR Tork No. 60M8001 Time Clock, both products of Tork Time Controls, Inc. Mount Vernon, N.Y. These devices incorporate pin-like elements extendable at the periphery of disc members to define the above-discussed time cams and provide access terminals on their face plates.

Exteriorly of units 52 and 54, access terminals 35 and 49 are interconnected in accordance with the invention by line 56 and access terminals 33 and 47 are likewise interconnected by line 58. Access terminal 45 is connected by line 60 to steam pressure-responsive switch means 62 which is in turn connected by line 64 to line L3, lines L3 and L4 comprising a further pair of power mains. Unit 62 is the customary steam pressure-responsive switch means referred to above having a mechanical input illustrated schematically by link 66 connected to steam pressure sensors serving to provide electrical continuity through unit 62 when steam pressure is below a first preselected limit, for example, 4 p.s.i. and thereafter until steam pressure rises to a second preselected limit, for example, 9 p.s.i.

Line 68 connects access terminal 47 to magnetic line starter 70 which comprises an armature 72 connected between lines 68 and 74, the latter extending to line L4, and a slug 75 connected at its respective ends to movable contact arms, both connected by line 76 to L3. As in the aforementioned existing arrangement, lines 78 and 80 extend from line starter contacts matable with the line starter contact arms respectively to oil-firing systems 82 and 84, each controlling the firing of individual boilers in a plural boiler steam generator. As will be evident, the control system of the invention may be employed with one or more boilers.

With time cam support members 26 and 40 in their illustrated positions, armature 72 of line starter 70 is unenergized. Even if electrical continuity exists from line L3 through switch 62 based on an existing pressure demand, electrical continuity does not exist between lines 60 and 68. Thus, while continuity exists from line 60 through access terminals 45 and 49 and to access terminal 35, terminals 32 and 34 are open.

As time cam support member 40 rotates from its illustrated position through approximately a five minute period, actuator 43 engages the lowermost illustrated time cam 42 and contact arm 50 is moved to its further position wherein continuity is provided between access terminals 45 and 47 and accordingly between lines 60 and 68. Armature 72 is energized if a pressure demand exists. Firing systems 82 and 84 are thus connected across lines L3 and L4 and if conditions internal thereto are proper, the associated boilers are fired. At the expiration of the time period established by such time cam 42, contact arm 50 returns to its normal position and continuity between lines 60 and 68 is interrupted, deenergizing armature 72 and discontinuing energization of firing systems 82 and 84.

The operation thus described repeats at spaced intervals, the extent and spacing of such time intervals being determined by the configurations and spacings of time cams 42, throughout the time period extending up to 5:30 A.M. whereupon time cam 28 engages actuator 30 and moves contact arm 36 from its normal position into its further position thereby providing continuity between access terminals 33 and 35. If contact arm 50 is in its normal position at this time, i.e., if one of time cams 42 is not in engagement with actuator 43, continuity between lines 60 and 68 is provided through the path comprising access terminal 45, contact arm 50, access terminal 49, line 56, access terminal 35, contact arm 36, access terminal 33, line 58 and access terminal 47.

As time cams 42 engage actuator 43 during concurrent engagement of the time cam 28 with actuator 30, contact arm 50 is moved to its further position, thereby interrupting such path of continuity between lines 60 and 68 through contact arm 36. However, an immediate substitute path of continuity is provided under these conditions through access terminal 45, contact arm 50 and access terminal 47. Since there is but an instant of time involved in the transition to such substitute path of continuity, armature 72 remains energized and such interruption in electrical continuity between lines 60 and 68 does not interrupt energization of firing systems 82 and 84. Accordingly, these firing systems are continuously energized during the period of time wherein time cam 28 engages actuator 30.

As time cam support member 26 is driven beyond 9 A.M., the control system returns to its above-discussed periodic excitation of firing systems 82 and 84 coextensively with the extents and spacings of time cams 42. As will be appreciated, the firing systems are excited during the continuous period determined by time cam 28 and during the spaced time periods defined by time cams 42 only where a pressure demand concurrently exists, namely, where continuity is provided through pressure-responsive switch 62.

In implementing fuel oil conservation by use of the control system of the invention, it is preferable beforehand to examine carefully a heating plant intended to be modified and to determine the time periods of energization of the oil firing systems thereof by its existing pressure demand control system. A tabulation is desirably made of the time extents of individual boiler firings over an hour or a period of several hours. By way of example, such examination may indicate that, in the course of a typical hour, boilers are fired during an initial seven minute period are then unfired for a four minute period, are next fired for a 7 minute period, are then unfired for a 5 minute period, are next fired for a 9 minute period, are then unfired for a 9 minute period, are next fired for a further 9 minute period, are then quiescent for a 7 minute period, and are next fired for the remaining 3 minute period of such hour. Total boiler firing time in the 1 hour period amounts to 34 minutes. Time cams 42 are now established to cumulatively define a time period less than 34 minutes, each cam in a group of three to constitute a time expanse of, for example, 9 minutes, and the time cams are spaced uniformly about the periphery of time cam support member 40. With such arrangement, time cams 42 dictate that, apart from the continuous time period established by time cam 28, energization of the oil firing systems shall be limited to a total period of 27 minutes during each hour, i.e., some 7 minutes less than was the case with the exisiing control system. Fuel conservation in this specific situation amounts to some 25 percent during hours outside of the period set by time can 28. As will be appreciated, such 27 minutes firing time may be further reduced in the event that pressure demands are not coextensive therewith. The extents of time cams 42 are desirably adjusted from such initially set extent, downwardly or upwardly, in accordance with resulting observed building heating levels.

The time period defined by time cam 28 desirably extends throughout the early morning hours where dwelling temperature is of particular concern. Accordingly, during this time period, the control system of the invention permits an effective reversion to the preexisting pressure demand control system. During periods of extremely cold weather, a complete reversion to pressure demand control may be effected by closure of a switch (not shown) by-passing switch means 22 and directly interconnecting lines 60 and 68. This switch is preferably thermostatically controlled, in accordance with the temperature differential between the interior and exterior of the building being heated or in accordance with actual exterior temperature.

In the particular instance of controlling the firing of steam boilers furnishing heat to multiple apartment dwellings, it is within the contemplation of the invention to incorporate a night clock to discontinue all boiler firing. For this purpose, the control system may include a normally-closed switch 86 series-connected with steam pressure-responsive switch 62. Switch 86 may be opened by night clock 88 during such period as from midnight to the hour at which time cam 28 engages actuator 30.

The control system of the invention may be readily adapted for use in controlling the firing of steam boilers furnishing heat to buildings other than multiple apartment dwellings. For example, where temperature comfort is required throughout an entire 24 hour period, i.e., where no early morning heat emphasis and midnight heat de-emphasis is involved, night clock 88 is dispensed with and clock controlled switch means 22 may be comprised solely of unit 54. For this purpose, lines 56 and 58 are disconnected respectively from access terminals 49 and 45 and unit 52 is dispensed with.

In still another instance, it may be desirable to provide boiler firing control by the use of any of the foregoing combinations of clock units 52, 54 and 88 during certain days of the week and to provide for limited boiler firing during other days of the week, e.g., weekend days. In this latter usage of the control system of the invention, a clock having a weekly cyclic time cam may be employed to control a further switch also series-connected with the line starter.

While the invention has been described in preferred implementation thereof with electromechanical clock apparatus, it will be evident to those skilled in the art that the invention may be practiced through the use of purely electronic apparatus.

While steam may itself constitute the medium circulated throughout a building and in heat exchange relation with ambient air in the rooms of the building, it will be appreciated that the control system of the invention may be employed where generated steam is used for supplying heat to another medium, e.g., water, air, etc., circulated throughout a building.

In the particularly discussed embodiment of the control system of the invention, unit 62 is operated in accordance with generated steam pressure levels. Such pressure levels are indicative of the heat content of generated steam. Those skilled in the art will recognize that there are other physical characteristics, such as temperature, which can be employed as a measure of the heat content of the steam. The invention, therefore, contemplates use of any switch means operated in accordance with a steam characteristic indicative of the heat content thereof.

The foregoing and various other changes and modifications to the particularly disclosed embodiment may be undertaken without departing from the spirit of the invention. Accordingly, the foregoing description of the invention is intended in a descriptive and not in a limiting sense. The spirit and scope of the invention is defined in the following claims.

What is claimed is:

1. In combination, in a system for controlling the firing of a steam boiler: first switch means for providing electrical continuity therethrough when steam generated by said boiler has heat content below a first predetermined heat content level and thereafter until such heat content increases to a second predetermined heat content level higher than said first level; and clock-controlled switch means series-connected with said first switch means, said clock-controlled switch means providing electrical continuity therethrough during a first time period of at least one hour in extent and providing electrical continuity therethrough during a plurality of spaced time intervals of a first one hour period immediately following said first time period, and providing electrical continuity therethrough during a further plurality of spaced time intervals of the one hour period immediately successive to said first one hour period, each said time interval being of continuous time extent of not less than multiple minutes.

2. The invention claimed in claim 1 wherein said further plurality of time intervals is identical to said first-mentioned plurality of time intervals.

3. In combination, in a system for controlling the firing of a steam boiler: first switch means for providing electrical continuity therethrough when steam generated by said boiler has heat content below a first predetermined heat content level and thereafter until such heat content increases to a second predetermined heat content level higher than said first level; first clock-controlled switch means series-connected with said first switch means, said first clock-controlled switch means providing electrical continuity therethrough during a first time period of at least one hour in extent and providing electrical continuity therethrough during a plurality of spaced time intervals of a first 1 hour period immediately following said first time period, and providing electrical continuity therethrough during a further plurality of spaced time intervals of the 1 hour period immediately successive to said first 1 hour period; and second clock-controlled switch means series-connected with both said first switch means and said first clock-controlled switch means, said second clock-controlled switch means providing electrical continuity therethrough during said first time period and during said spaced time intervals of such successive one hour periods and interrupting electrical continuity therethrough during a further time period of at least 1 hour in extent.

4. In combination, in a system for controlling the firing of a steam boiler: first switch means for providing electrical continuity therethrough when steam generated by said boiler has heat content below a first predetermined heat content level and thereafter until such heat content increases to a second predetermined heat content level higher than said first level; and first clock-controlled switch means series-connected with said first switch means, said first clock-controlled swtich means providing electrical continuity therethrough during a first time period of at least 1 hour in extent and providing electrical continuity therethrough during a plurality of spaced time intervals of a first 1 hour period immediately following said first time period, and providing electrical continuity therethrough during a further plurality of spaced time intervals of the 1 hour period immediately successive to said first 1 hour period, said clock-controlled switch means comprising a first time cam support member, means for driving said time cam support member through one cycle during each 24 hour period, a time cam supported by said first time cam support member and a normally-closed switch selectively opened by said time cam, a second time cam support member, means for driving said second time cam support member through one cycle during each 1 hour period, spaced time cams supported by said second time cam support member and a normally-open switch selectively closed by said spaced time cams.

5. The invention claimed in claim 4 wherein said normally-closed switch comprises first and third terminals electrically connected thereby during such normal switch closure and a second terminal otherwise connected to said normally-closed switch first terminal and wherein said normally-open switch comprises first and second terminals electrically connected thereby upon switch closure.

6. The invention claimed in claim 5 further including means for connecting said normally-closed switch first terminal to said first switch means and for connecting said normally-closed switch second and third terminals separately to said normally-open switch terminals.

7. A control system for energizing an oil-fired boiler comprising:

a. first switch means having a first terminal, a second terminal and a third terminal and a contact arm having a normal position for interconnecting said first and third terminals and movable therefrom into a further position for interconnecting said first and second terminals;

b. first clock means for moving said first switch means contact arm from said normal position thereof into said further position during parts of successive hours;

c. second switch means having first and second terminals and a contact arm having a normal position and movable therefrom into a further position for interconnecting said second switch means first and second terminals;

d. second clock means for moving said second switch means contact arm into said further position during parts of successive days;

e. third switch means operated in accordance with the heat content of steam generated by said boiler; and f. circuit means for connecting said first switch means first terminal to said third switch means and for connecting said first switch means second and third terminals separately to said second switch means terminals.

* * * * *